US005487253A

United States Patent [19]

Hieltscher et al.

[11] Patent Number: 5,487,253

[45] Date of Patent: Jan. 30, 1996

[54] DEVICE FOR CONVEYING AND PROCESSING PACKS FOR LIQUIDS

[75] Inventors: Uwe Hieltscher, Bensheim; Udo Liebram, Pfungstadt; Wilhelm Reil, Bensheim; Peter Sattler, Zwingenberg, all of Germany

[73] Assignee: Tetra Laval Holdings & Finance S.A., Pully, Switzerland

[21] Appl. No.: 231,688

[22] Filed: Apr. 25, 1994

[30] Foreign Application Priority Data

Apr. 23, 1993 [DE] Germany ..... 43 13 325.8

[51] Int. Cl.[6] ..... B65B 3/00; B65B 43/00; B67B 3/20

[52] U.S. Cl. ..... 53/281; 53/282; 198/775

[58] Field of Search ..... 53/167, 281, 284.5, 53/266.1, 329.3, 329.5, 282; 426/399; 198/468.8, 468.6, 775

[56] References Cited

U.S. PATENT DOCUMENTS

| | | | |
|---|---|---|---|
| 3,332,788 | 7/1967 | Barnby | 426/399 |
| 3,356,510 | 12/1967 | Barnby | 53/167 X |
| 3,382,844 | 5/1968 | Vogt . | |
| 3,766,709 | 10/1973 | Zausner | 53/167 |
| 3,783,581 | 1/1974 | Pierce | 53/167 X |
| 3,973,665 | 8/1976 | Giammanco | 198/775 |
| 4,056,921 | 11/1977 | Gilliand et al. | 53/167 |
| 4,074,961 | 2/1978 | Reil . | |
| 4,094,124 | 6/1978 | Ljungcrantz . | |
| 4,175,140 | 11/1979 | Bachmann et al. | 426/399 |
| 4,208,852 | 6/1980 | Pioch | 53/167 |
| 4,258,532 | 3/1981 | Dilot . | |
| 4,269,016 | 5/1981 | Kopp et al. . | |
| 4,518,078 | 5/1985 | Garrett | 198/775 |
| 4,534,695 | 8/1985 | Stump et al. | 198/775 |
| 4,558,984 | 12/1985 | Garrett | 198/775 X |
| 4,566,251 | 1/1986 | Spisak et al. . | |
| 4,734,268 | 3/1988 | Redding et al. | 53/167 X |
| 4,759,171 | 7/1988 | Bruveris et al. . | |
| 4,856,646 | 8/1989 | Sjöstand . | |
| 4,929,459 | 5/1990 | Silvestrini | 426/399 |
| 4,986,058 | 1/1991 | Carlsson et al. . | |
| 5,001,886 | 3/1991 | Turtschan | 53/167 |
| 5,079,903 | 1/1992 | Hankansson . | |
| 5,186,306 | 2/1993 | Sjöstand . | |

FOREIGN PATENT DOCUMENTS

| | | |
|---|---|---|
| 0141572 | 5/1985 | European Pat. Off. . |
| 0513439 | 11/1992 | European Pat. Off. . |
| 3014063 | 10/1981 | Germany . |
| 3517074 | 11/1986 | Germany . |
| 2855088 | 10/1987 | Germany . |
| 3824923 | 2/1989 | Germany . |
| 3941992 | 6/1991 | Germany . |
| 4116370 | 11/1991 | Germany . |
| 86 | of 1914 | United Kingdom . |
| 1315158 | 4/1973 | United Kingdom . |

*Primary Examiner*—Horace M. Culver
*Attorney, Agent, or Firm*—Burns, Doane, Swecker & Mathis

[57] ABSTRACT

In a device for conveying and processing packs for liquids, a feed conveyer is provided. The device further includes processing stations, including processing stations for filling and closing of the packs, arranged sequentially, the feed conveyor feeding packs to the processing stations. The device includes a removal conveyer for removing processed packs from the device. The device includes a first main conveyer device, the first main conveyer device being a one-step vertical conveyer device and having at least one vertically movable bridge with at least one horizontally arranged support rod for transporting a plurality of packs simultaneously, and a second main conveyer device, the second main conveyer device being a one-step horizontal displacement device. The first and the second main conveyer devices have a common conveyance position at a bottom one of two conveyance positions of the first main conveyer device. The processing stations for filling and closing of the packs are arranged vertically above the first and the second main conveyer devices. The support rod is of sufficient length to transport a plurality of packs arranged in a row relative to one another.

11 Claims, 11 Drawing Sheets

Figure 1:
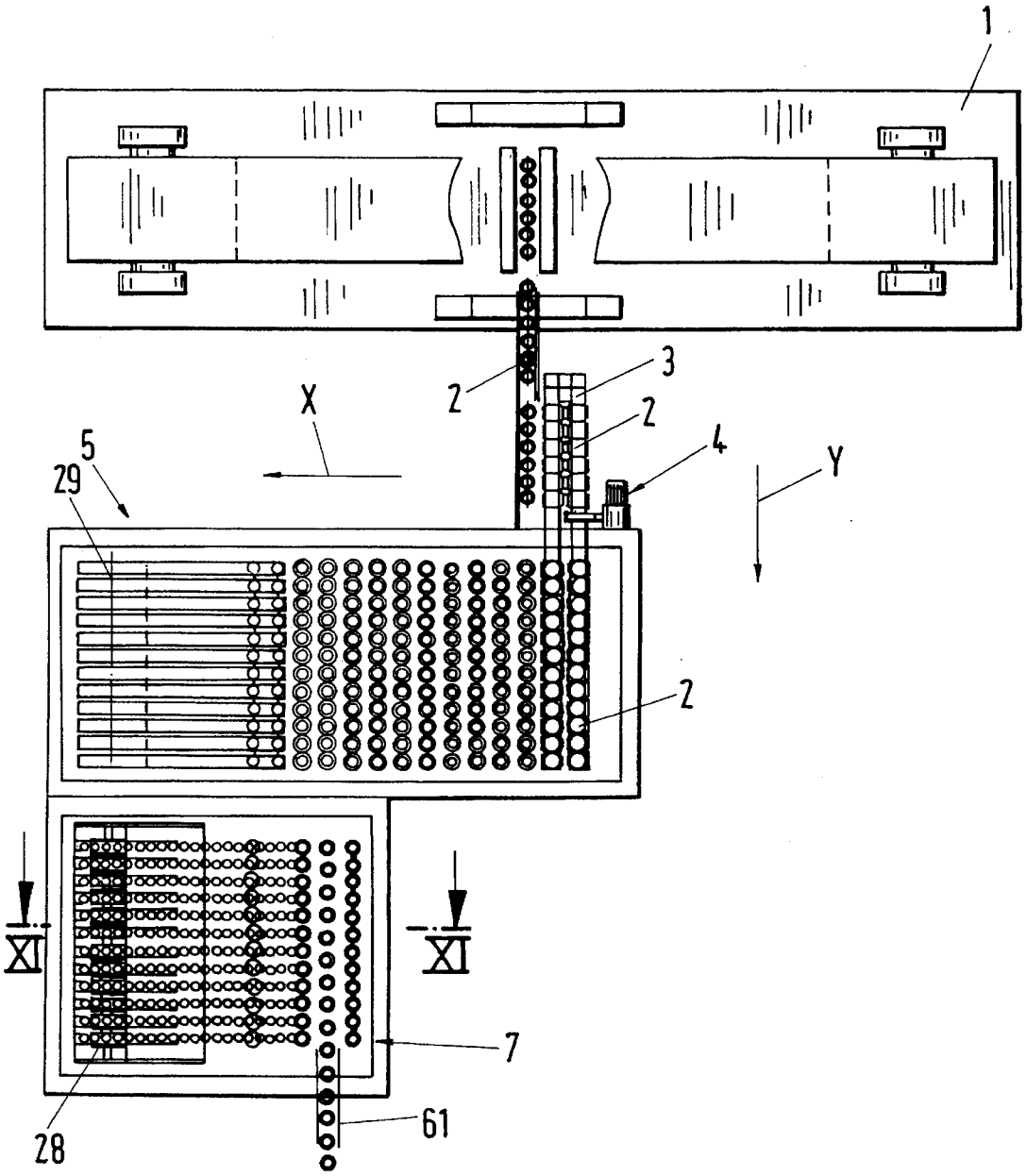

63
8
15
2
9
9
13
Y
11
23
23
10
8
14
12

DEVICE FOR CONVEYING AND PROCESSING PACKS FOR LIQUIDS

The invention relates to a device for conveying and processing packs for liquids, having a feed conveyer, two main conveyer devices, processing stations arranged behind one another, a removal conveyer and drives.

Of the many known packs for liquids, the afore-mentioned device is able to convey and process a type of pack which is made of plastics material, preferably by deep-drawing half-shells and by joining the two together, and by closing them all around, apart from an opening. The opening is arranged in the top, and it can occupy varying parts of the top, or only forms a small hole in the top. Since the packs are packs for liquids, and the liquid is usually filled into the pack by force of gravity, this invention is based on the fact that the pack stands in a vertically upright position on its bottom, that tubular side walls are arranged between the bottom and top, and that the pack therefore has a longitudinal central axis which is arranged substantially in the vertical extent.

The device according to the invention which is intended for this kind or type of pack for liquids is therefore designed in such a way that the force of gravity, i.e. the vertical force in the direction of the perpendicular in the following description plays a part to the effect that a distinction is made between "top" and "bottom", for the flowable contents preferably flow from the top to the bottom on filling. Devices are known for filling and closing packs for liquids, wherein various conveyers and processing stations are provided, and wherein the individual stations are arranged behind one another in a so-called horizontal X-extent for the processing operation.

Therein, conveyers exist with a direction of movement in a so-called Z-extent; and conveyers exist with a third direction of movement in a so-called Y-extent, moving substantially horizontally in turn, wherein the horizontal third direction of movement is perpendicular to the horizontal second direction of movement. If the three directions of movement are represented by straight two-directional arrows, then these are perpendicular to each other, like the X-, Y- and Z-extent of the space coordinates.

With the known devices for conveying and processing packs for liquids, these latter are pushed in transportation boxes and are moved in them in the three conveyance directions. The known machine was therefore relatively expensive and some parts of the device were at times prone to malfunctions.

The aim of the invention is therefore to simplify the conveyer device, mentioned in the introduction, and provided with processing stations, and to design it in a more reliable way, particularly by the provision of other paths of movement to increase its output.

The problem is solved by way of the invention in that the first main conveyer device is a one-stage vertical conveyer device, the second main conveyer device is a one-stage horizontal displacement device, both main conveyer devices have a common conveyance position which is the bottom of two conveyance positions with the vertical conveyer device, and that the processing stations for filling and closing are arranged vertically above the main conveyer devices.

By virtue of the new features, the device provides for step-wise transportation which is carried out by two main conveyer devices, wherein the first one is the vertical conveyer device and the second one is the horizontal displacement device, both devices operating in a single step. The respective pack is thus moved through a step by each main conveyer device in succession. The vertical conveyer device has an upper and a lower position, whilst the horizontal displacement device adopts an advanced and a retracted position and alternates oscillatingly between these positions. So that the pack which is to be processed is conveyed in the correct way, the lower position of the vertical conveyer device coincides with the advanced position of the horizontal displacement device; and the next time it coincides with the retracted position of the device. This makes it possible for each pack to be displaced horizontally, and then to be raised vertically up from the displacement device, and after an idle position to be lowered back into another position of the horizontal displacement device and engaged there.

Therein, it is desirable if the respective pack is only ever advanced by the horizontal displacement device, the pack thus only ever being advanced in the so-called X-extent horizontally along the series of processing stations; and only ever being removed and standing still when the horizontal displacement device moves back into its retracted position. With the features according to the invention, this is the direction of movement of the pack with the aid of the device, namely through one step to the right, and then through one step upwards, followed by a pause for a rest or for a processing operation, and then movement down, and then a one-step movement into the next advanced position, and from that position being removed into the upper position etc.

The design and movement of the two main conveyer devices are the focal points of the device according to the invention. Nonetheless, it will be appreciated that the packs which are still unprocessed are fed by a feed conveyer, and that the filled and closed packs at the rear end of the main conveyer devices are guided and removed on a removal conveyer.

Therein, it is expedient if the feed conveyer aligns the packs individually or in a row in such a way that their longitudinal central axis is disposed in the vertical extent, and if the packs are loaded in this vertical direction from an upper position down into the main conveyer devices, that is to say in their one common conveyance position.

It is also expedient if the removal conveyer is arranged downstream from the main conveyer devices, i.e.—viewed in the conveyance direction of the packs—at the end to the rear of the main conveyer devices, particularly preferably at least behind the vertical conveyer device or arranged thereon in such a way that the processed packs are removed in the afore-mentioned Y-extent, i.e. perpendicularly to their direction of conveyance in the main conveyer devices, but substantially horizontally.

The invention is therefore also expediently designed if the vertical conveyer device has at least two separately driven sections, each of which has a vertically movable bridge with at least one horizontally arranged support rod. The separated pack or a row of at least two packs, for example up to ten packs, is/are carried by the support rods, which, according to the present invention, are preferably equal in length to a plurality of packs arranged behind one another in the row. In this way, the support rods provide passages which extend in the Y-extent. The more general solution is to transport at least one individual pack, and for such a solution the support rod would be suitably short in its length. Nonetheless, the vertical conveyer device according to the invention is designed in such a way and is structured in a way which is as simple as possible technically in that depending on the type of processing or a group of appropriately designed processing stations a plurality of packs is raised or lowered in various positions simultaneously perpendicularly in the vertical conveyer device. Therefore, each group of processing stations is assigned to a section of the vertical conveyer device with the intention of simultaneously raising and lowering a plurality of support rods inside the section which are fixed to the same bridge.

It is particularly advantageous therein, if, according to the invention, the vertical conveyer device has three sections with three bridges of different length, if the rear bridge in the conveyer device as a whole (of the horizontal displacement device) carries two support rods and if the central bridge has three support rods which are arranged adjacent to each other, in parallel relationship, at spacings apart. This more concrete design allows the rear bridge to be arranged under the last processing station, where, for example, a plastics film is stuck or sealed at the top on the smooth circular edge of the collar of the pouring opening of the pack. Therein, the rear one of the two support rods can be designed in the form of a bar or in the form of a bar-like corner for it to be better adapted to a removal conveyer, e.g. a continuous belt or a link belt. If three support rods are provided with the central bridge, then with one preferred embodiment it is possible to use one support rod for an emptying station and the two others for filler stations, if two filler stations are arranged behind each other in the series of processing stations. Either one pack can be filled with half the volume of the contents; or, with another embodiment, the packs can be filled in pairs, which is not, however, provided within the scope of the embodiments described here.

The third and therefore frontmost bridge can be longer in design, for example, and an entire series of packs (or a series of rows of packs) is simultaneously raised in various processing stations, since the processing times are of equal length, for example.

With another embodiment of the invention, the horizontal displacement device has two axially movable guide rods, arranged in parallel relationship and at a spacing apart, the guide rods each having a plurality of transversely arranged mounting strips which run after one another in mutually parallel relationship at an axial spacing apart and in pairs in the space between the guide rods, and leave a central slot. This description of the horizontal displacement device requires some mention of the geometric extent of the individual components. On the outside, that is to say at the sides of the horizontal displacement device are disposed the afore-mentioned guide rods. The term, "Y-extent" which has been used hereinabove, which extends transversely to the entire conveyor direction of the horizontal displacement device is the spacing between the two guide rods. The easiest way of imagining this is if the horizontal displacement device is considered in the Z-extent from the top to the bottom, that is to say vertically onto a plane which is braced by the X-axis, that is to say the entire conveyer device of the horizontal displacement device, and the Y-axis. Therein, in one particularly preferable case, it is very expedient to arrange the one guide rod at the topmost or rearmost position on the Y-axis, for example, slightly higher or lower than the other guide rod which extends at the front or bottom end of the Y-axis, parallel to the first guide rod. This can be designed for structure-related or manufacture-related reasons in such a way that the one guide rod is disposed in the Z-extent at a somewhat higher level than the other guide rod. However, it is not possible to see this difference in the view taken of the afore-mentioned X-Y-plane. The two mutually parallel guide rods are movable axially. This means that each guide rod is able to move oscillatingly with a specific amplitude in the axis which is disposed in the X-extent. The amplitude corresponds to a conveyance step in the X-extent. This causes a step-wise conveyance movement of the horizontal displacement device in the horizontal extent, i.e. in the X-extent. Step by step, a pack (a row of packs in one particularly preferable embodiment) is advanced in the X-extent and is then raised, and later lowered again, by the other vertical conveyer device up into the processing station. This lifting operation obviously takes place in the Z-extent.

A plurality of mounting strips extends transversely from each guide rod. A first group of mounting strips is fixed to the first guide rod, and a second group of mounting strips is fixed to the second guide rod. Both groups of mounting strips run after one another. They are all disposed parallel to each other, not only those within a group, but also the mounting strips of one group to those of the other group. The respective mounting strips do not, however, make contact in the centre, but leave a central slot between them which extends in the X-extent. The central slot is disposed approximately in the centre, between the two guide rods and parallel thereto.

The mounting strips within each group are arranged at spacings apart, wherein the spacings in the one group are equal to the spacings between the mounting strips of the other group, so that in the surface or in the space between the guide rods two mounting strips are oppositely disposed to each other and form a pair. Each mounting strip of the one group thus corresponds to a mounting strip of the other group, so that these two mounting strips form a respective pair. The spacing between the mounting strips is said to be "axial", for it lies in the X-extent and thus in the direction of the axis of the guide rods.

This arrangement of mounting strips creates a rake-like supporting surface for the packs to be moved, and it is advantageous in that between the rake-like mounting strips oriented towards each other, further elements can be moved vertically up and down in the Z-extent.

Therefore it is particularly advantageous, if, according to the invention, a transverse slot is provided by the axial spacing between each of two adjacent mounting strips, the transverse slot extending transversely to the central slot, and if the two guide rods are connected by a drive bar which extends transversely between them. The drive bar provides horizontal oscillating movement in the X-extent in such a way that both guide rods are simultaneously moved into the advanced position and are then moved into the retracted position. All mounting strips are obviously moved in the same way together with the guide rods. By way of the spacing which is taken up in the X-extent or in the axial extent of the guide rods, between two adjacent mounting strips, a transverse slot is provided which extends in the Y-extent, thus horizontally and perpendicularly to the X-axis. Therefore, pairs of transverse slots extent vertically the central slot which form a grid-like screen of a space (a space of slots) which are complementary to the physical parts, through which space other elements of the device can move up and down in the vertical extent or Z-extent.

With a further development of the invention, the bridges of the vertical conveyer device are movable vertically through the central slot and the support rods are movable vertically through the transverse slots between the mounting strips. It can also be seen that advantageously the vertical conveyer device is movable transversely to the horizontal displacement device, without the superstructures of the two devices causing a disturbance to each other, naturally on the condition that when the one device moves the other remains at a standstill in the correct position.

By way of the afore-described elements and superstructures it is possible for both the main conveyer devices to take care of the afore-described path of the packs to be processed. The packs thus arrive, via the feed conveyer, at the two main conveyer devices, and are taken from one processing station to another by step-wise advancing, lifting, processing, lowering and further advancing operations until the pack is filled.

Closure then takes place in a first step. To this end, the invention provides that the processing stations have a heated, substantially stationary vacuum stamp, next to which an advancing device operating with vacuum means is arranged for intermittently feeding sections of film which are able to be drawn off from a supply roll in the form of a film web.

The last processing station of the afore-described processing stations arranged in a series behind one another is the closing station, for closing in one first step, namely with a section of a plastics film. The pack was closed all except for the opening, through which it was filled, and a uniform sealing- or adhesive face was provided on its upper edge, onto which face the afore-mentioned film section of plastics material is applied. It is applied by way of the features according to the invention in that the section of film which is separated from the film web is held by vacuum to a heated vacuum stamp, against which the filled pack (and, with the preferred embodiment, the row of filled packs) is raised by the vertical conveyer device and pressed against it in such a way that the heated section of film is released from the vacuum stamp and is deposited on the sealing- or adhesive face of the pack. During delivery, the vacuum is clearly switched off on the heated vacuum stamp.

With the aid of the vertical conveyer device, the closed pack is thus brought back down into the bottom conveyance position in the Z-extent, where it is then ready to be removed. The device for conveying and processing the packs for liquids is further characterised according to the invention in that in the region of the removal device is a top screw on device, preferably with an integrated separating device for the closed packs, wherein a receiving means which can be rotated about two mutually vertical axes receives the separated tops and screws them onto the pack. Basically, this screwing on of the top is synonymous with closing the pack, but it is a second stage of the closure operation, where, for reasons of safety and to prevent mechanical damage to the plastics film which seals the pack a top is screwed on the outside over the plastics film. To this end, the top is in the form of a band and the bands hang together in a roll, wherein the tops are joined together by way of a small bridge. By way of example, this bridge can be about 10 mm in length which forms the band of the top which can then be wound up onto the supply roll. The tops are then taken from the roll one by one, separated, e.g. by a cutting blade, and are pushed onto the afore-mentioned receiving means which has a disc-like surface which can be driven rotatingly about the two afore-mentioned axes. The receiving means rotates about a first axis disposed in the Y-extent, for example, in the correct position above the pack, and by virtue of the receiving means rotating about the second axis which has been displaced by 90° through the latterly mentioned rotational or pivotal movement, rotation of the top is initiated and it is screwed onto a screwthread which may be disposed by way of example and preferably on the outer face of a collar, adjacent to the opening closed by the film.

If so desired, the device as a whole can also operate under aseptic conditions. To this end, it is advantageous, if, according to the invention, over part of the length of the series of processing stations arranged behind one another is a housing with feed lines and outlet lines for sterile gases. If the series of processing stations and thus the individual processing operations which follow on from one another are considered from the start to the end of the afore-mentioned series, i.e. in the X-extent, in the horizontal direction of movement of the horizontal displacement device, then in some of the stations disposed upstream it is possible to operate without sterilisation, e.g. projecting corners of the empty pack can be cut off and an upper edge on a collar can be smoothed next to the pouring opening in order to create a sealing- or adhesive annular face, without these operations having to be carried out in aseptic areas. Otherwise, the pack is obviously filled in the same way.

In order to sterilise the inside and pouring region of the pack after it has been filled, a sterilisation region is provided to which is connected the filling and closing region. These regions are disposed over the afore-mentioned partial length of the pow of processing stations, and are provided with the afore-mentioned housing. The packs are pushed into the housing and are pushed back out from it by the horizontal displacement device, and for this reason the housing is provided with channelling means in the form of the afore-mentioned channelling units. The housing is suitably constructed to enable both main conveyer devices to move at least partly in the housing, wherein the drives themselves do not have to be provided in the sterile region.

According to the invention, it is also possible, in the processing stations, to arrange in the housing a series of intensive chambers which are arranged behind each other and to close them by movable covers. This means that the packs can be sterilised more quickly and at less expense, since a smaller concentrated volume of the sterile medium and thus of sterilising gases must be sufficient in the smaller intensive chambers, and with respect to sterilising the packs it is not necessary to fill the whole housing with highly sterile gas. Thus, by providing intensive chambers on the channelling units the very great sealing requirements no longer have to be imposed.

Therein, it will be appreciated that the strip of the film sections must also be guided through an aseptic channelling means into a sterile chamber before the separated and heated film sections are sealed onto the filled pack by way of the heated vacuum stamp.

Figure 2:
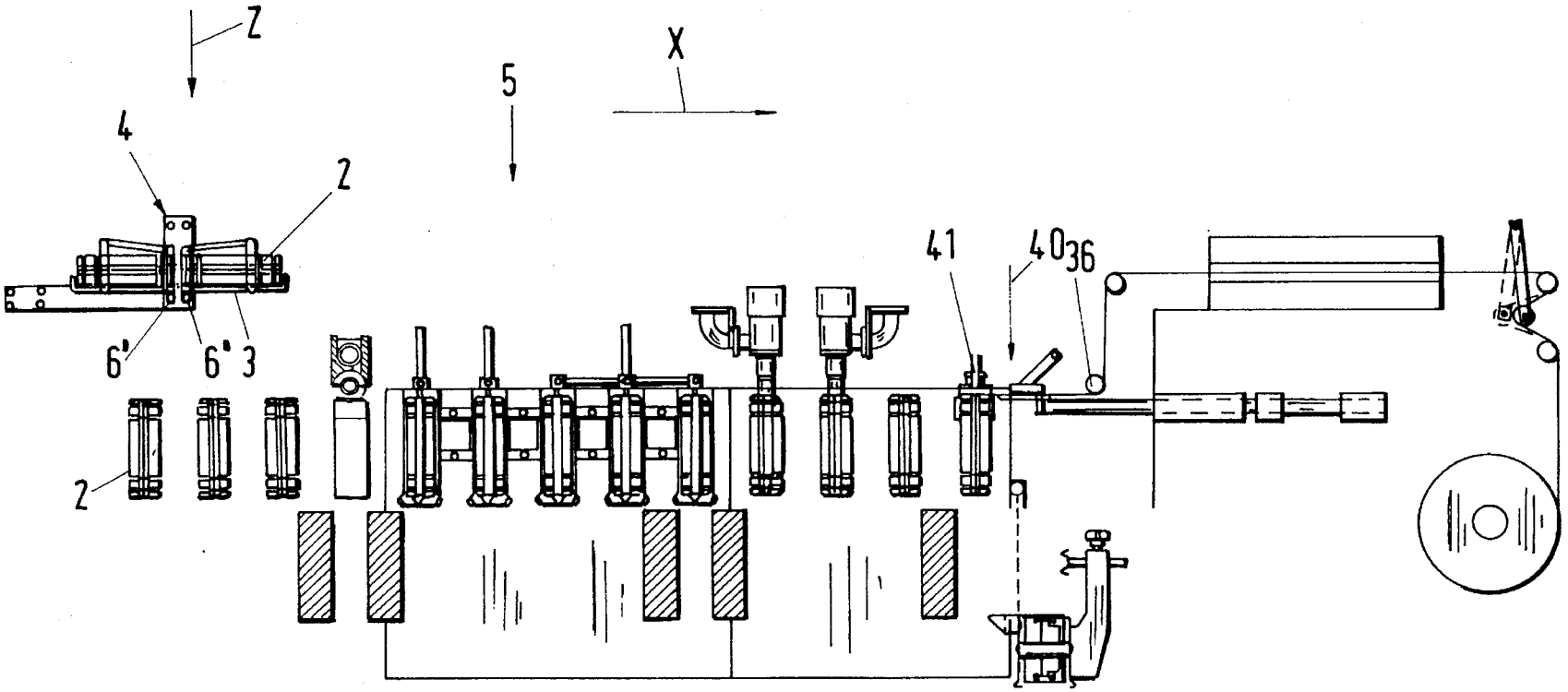
Figure 3:
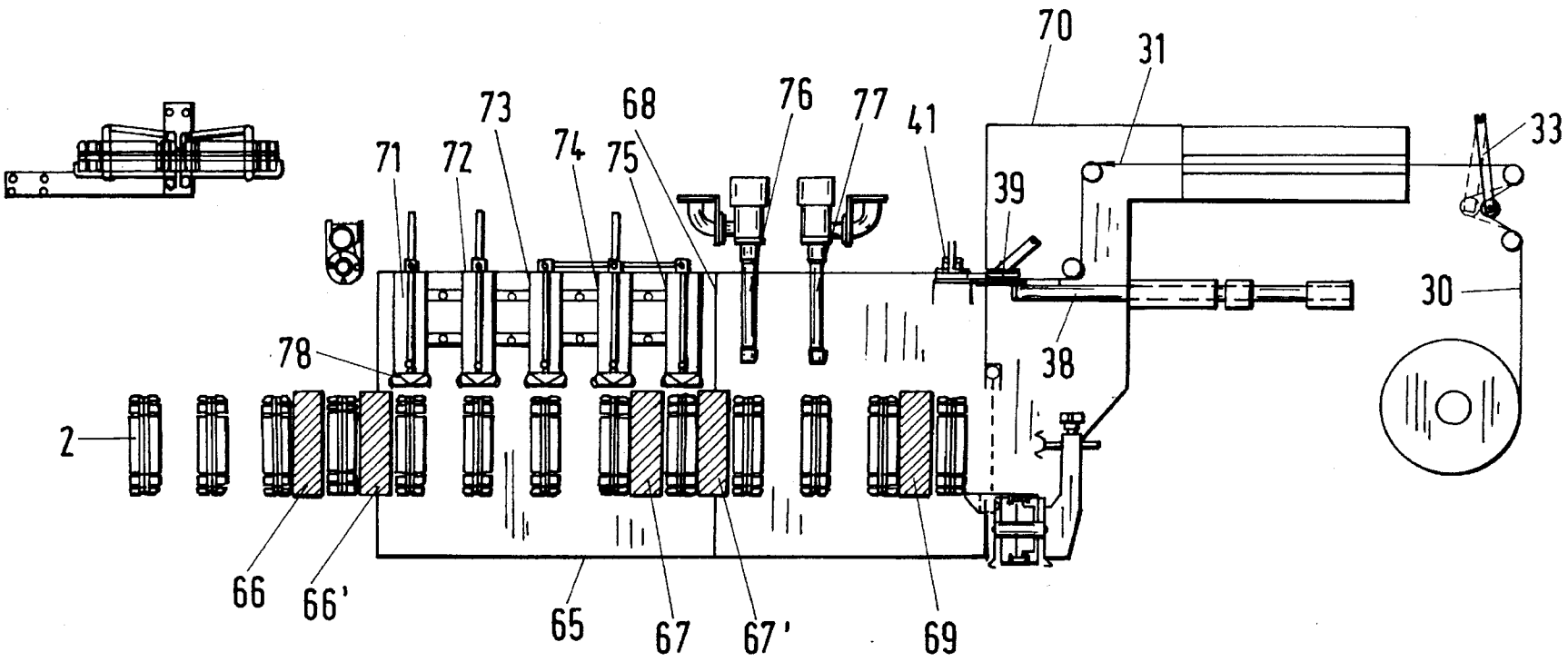
Figure 4:
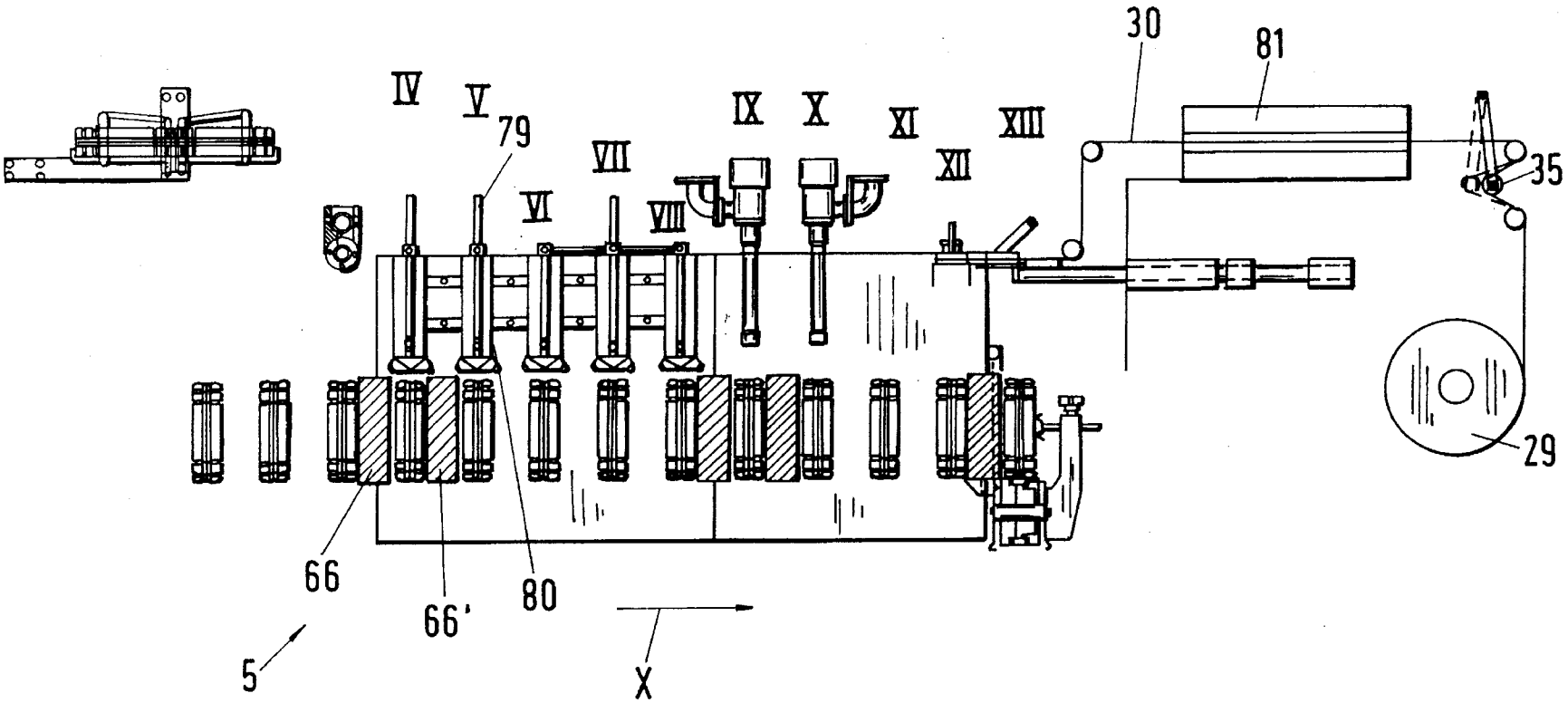
Figure 5:
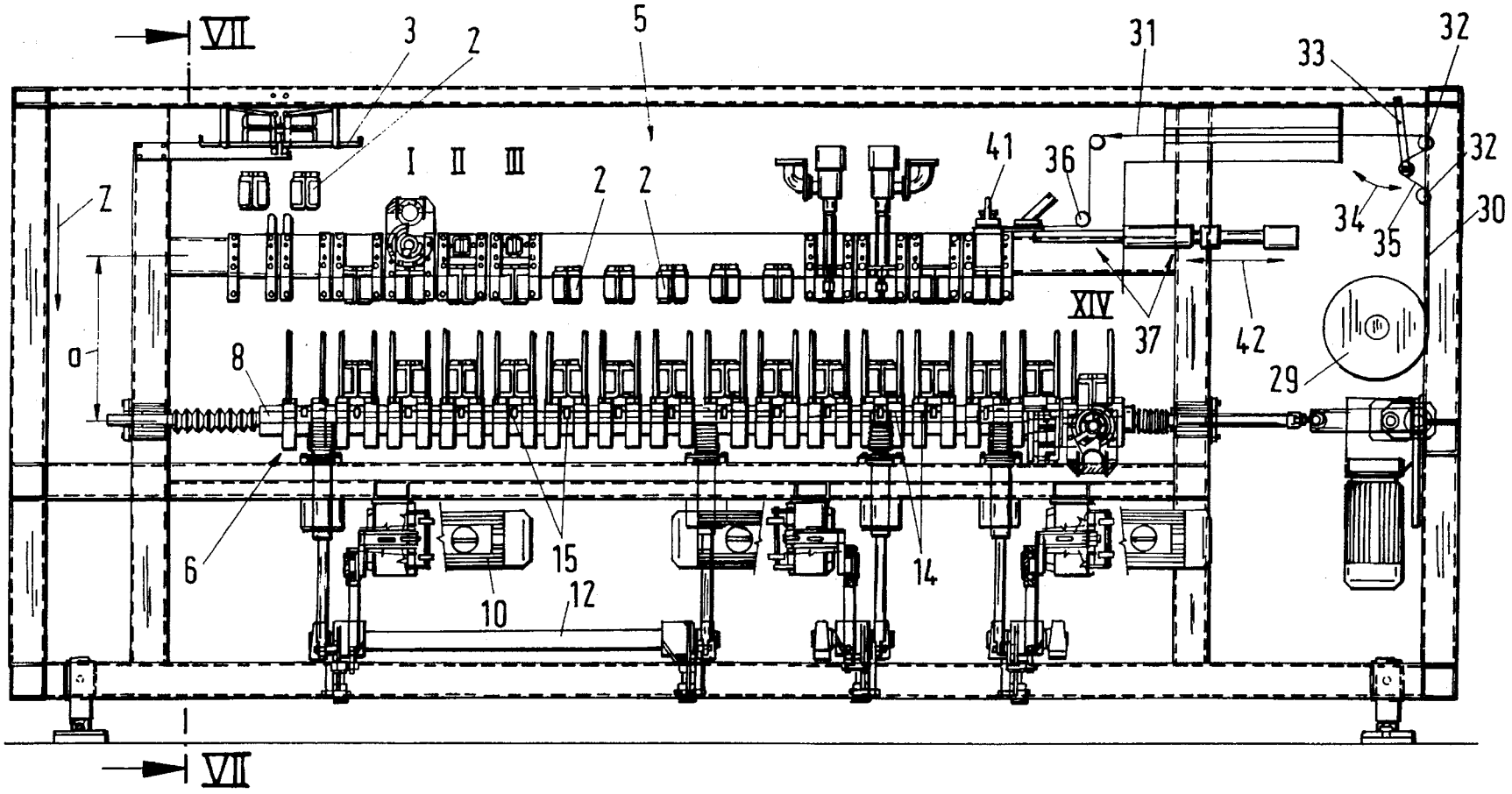
Figure 6:
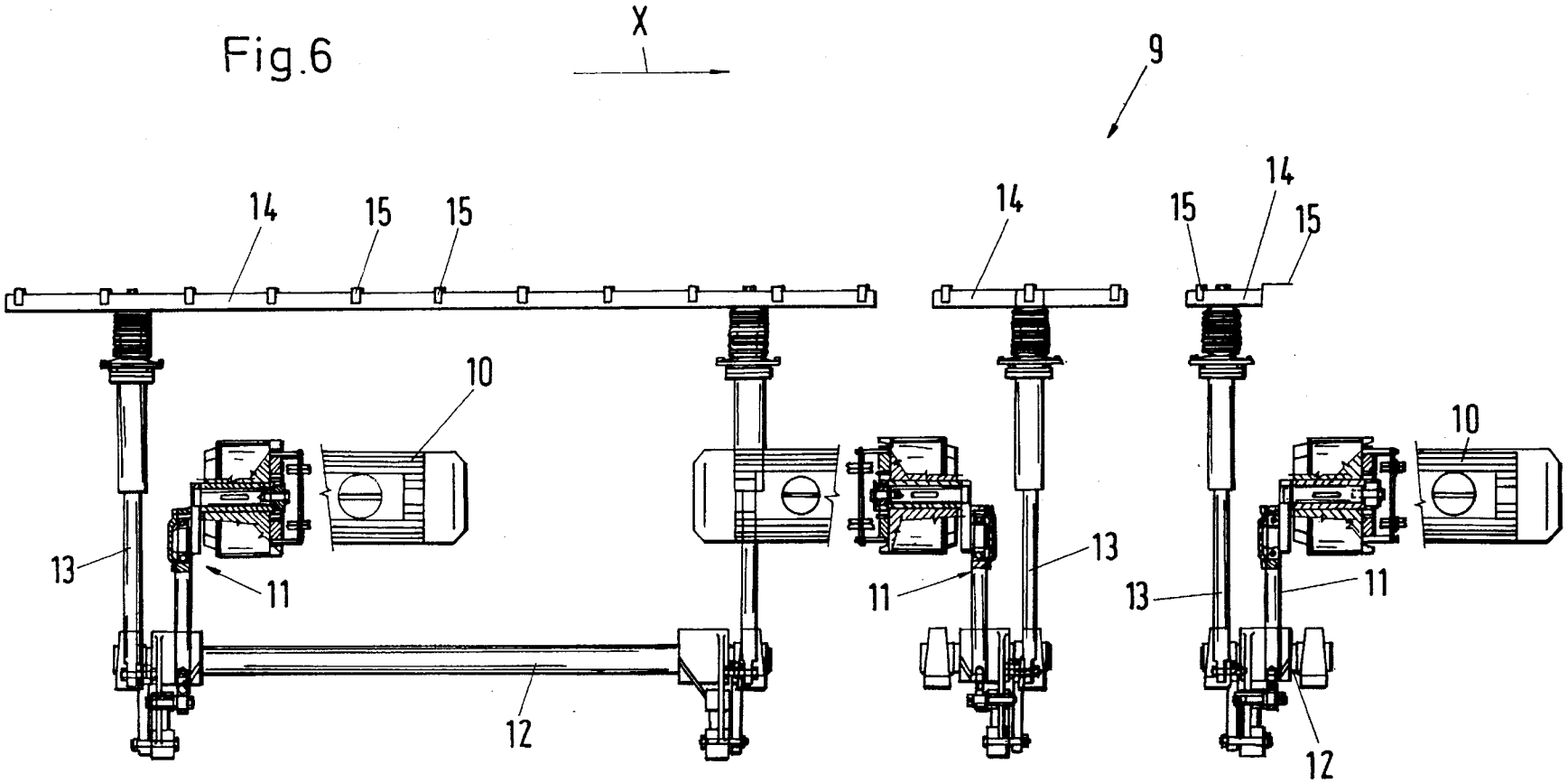
Figure 7:
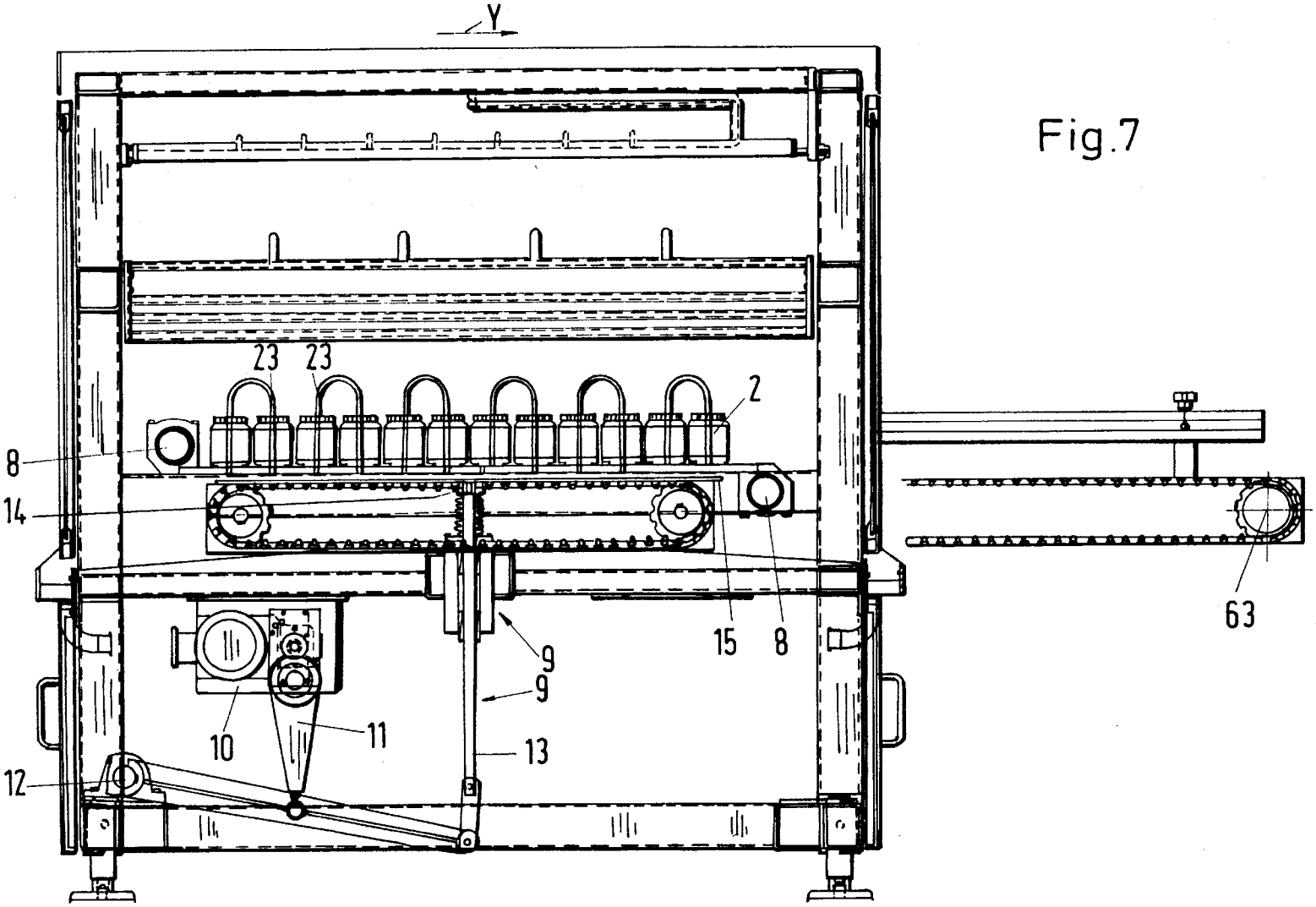
Figure 8:
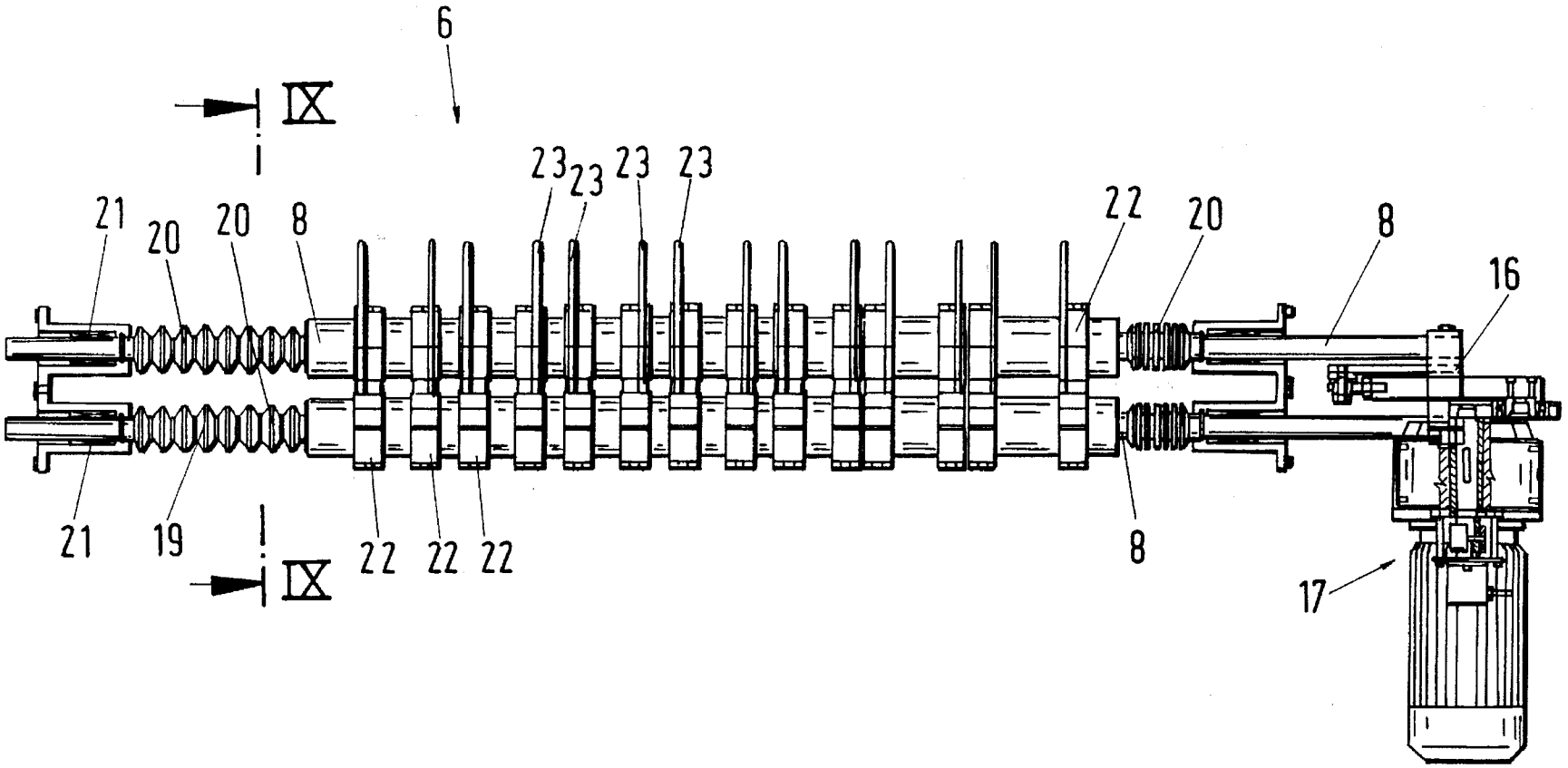
Figure 9:
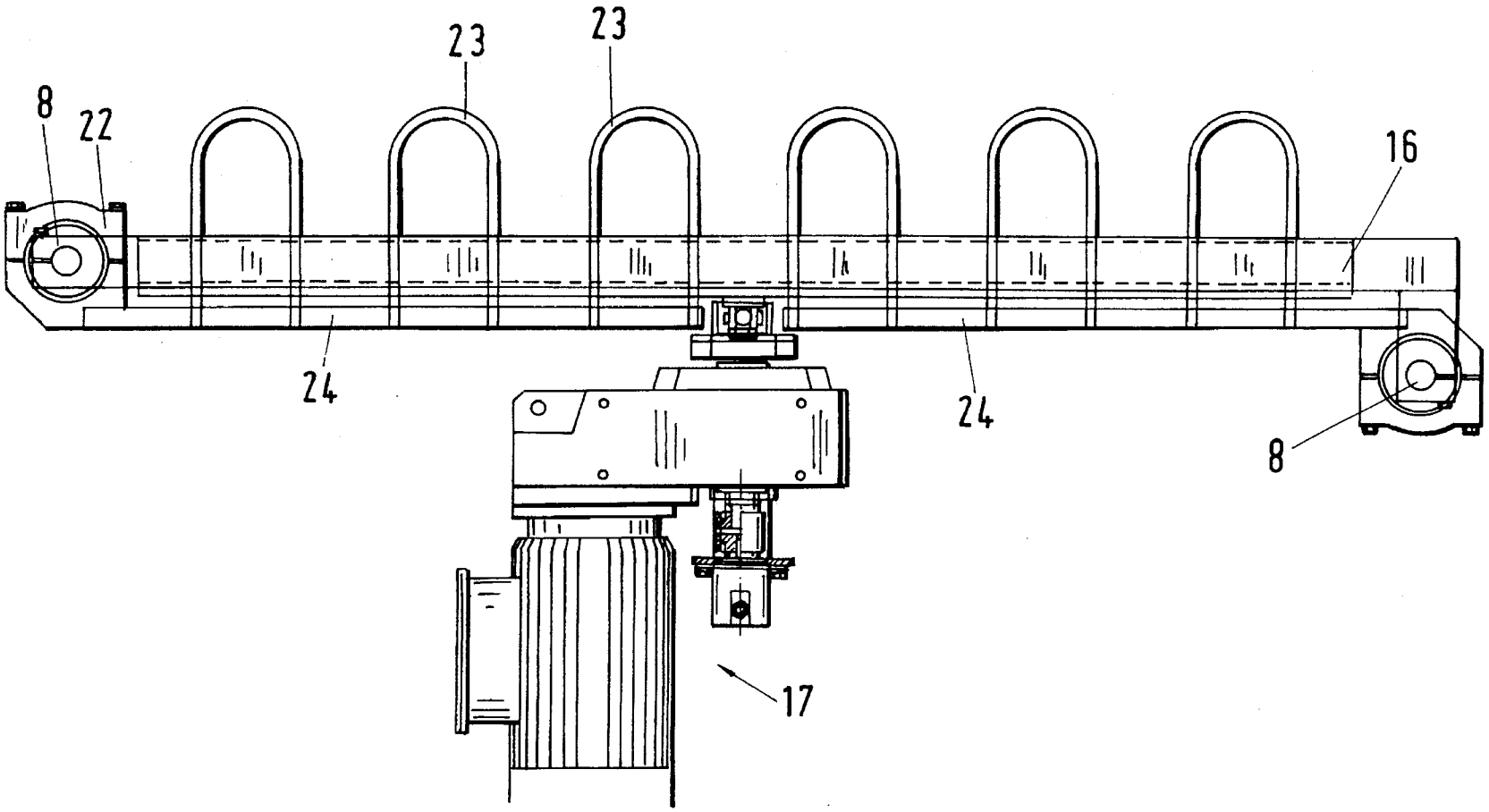
Figure 10:
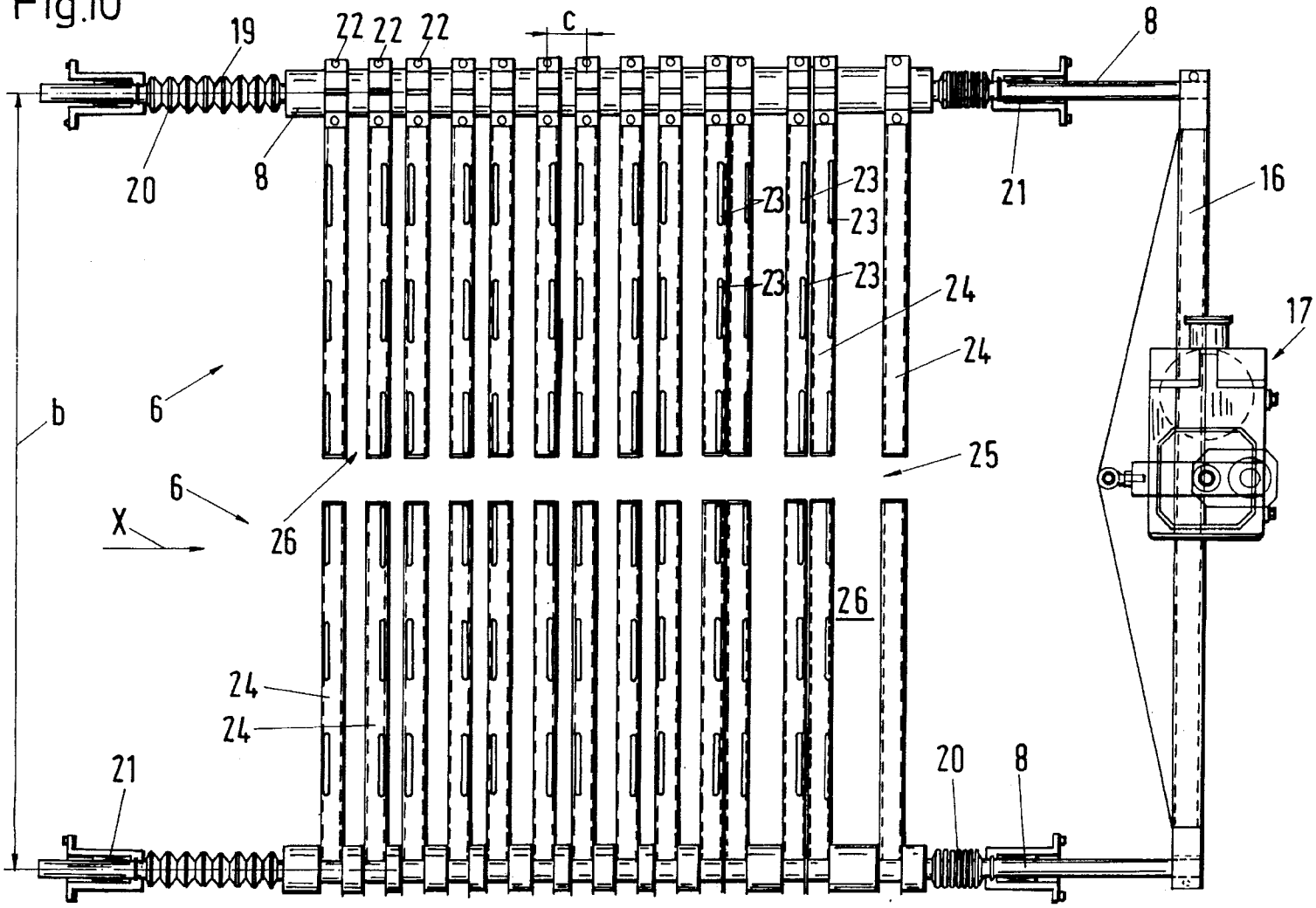
Figure 11:
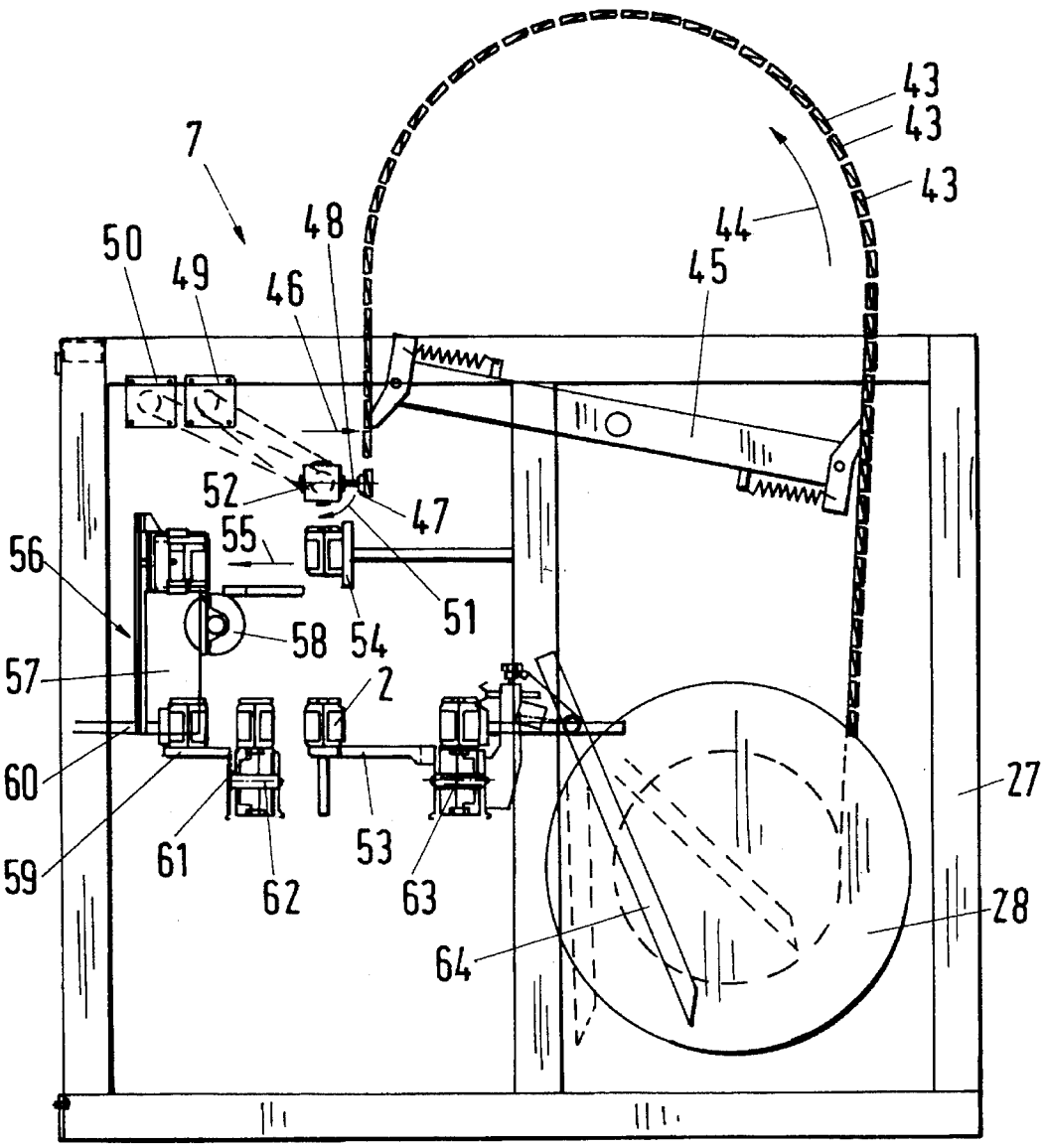

Further advantages, features and possible applications of the present invention will emerge from the following description of preferred embodiments in conjunction with the accompanying drawings, wherein:

FIG. 1 is the plan view of the installation as a whole with a heat shaping machine, shown at the top in the elongate rectangle, with the processing device with the various processing stations according to FIG. 5, illustrated in the centre rectangle, and the top screw on device according to FIG. 11, illustrated by the small rectangle at the bottom, FIG. 2 illustrates a specific series of packs in a first position, FIG. 3 like FIG. 2 also illustrates the series of packs in a second position, FIG. 4 like FIGS. 2 and 3 illustrates a series of packs in a third position, FIG. 5 shows the side view of the processing device with the individual processing stations arranged behind one another, without aseptic spaces, FIG. 6 shows three individual devices, taken from FIG. 5, for vertically removing the packs, that is to say the first main conveyer device and the vertical conveyer device, FIG. 7 is an illustration of the device as a whole from the left-hand side along the line VII—VII in FIG. 5, FIG. 8 is the device on its own which is shown in FIG. 5 for horizontally displacing the packs, wherein the two horizontal guide rods are shown disposed upon each other at spacings apart, FIG. 9 is a view of FIG. 8, from left to right, in the direction of the arrows IX—IX, FIG. 10 is a plan view of the horizontal displacement device for the packs, looking from top to bottom in FIGS. 8 and 9, and FIG. 11 is a side view of the device for screwing on the tops, looking along the line XI—XI in FIG. 1.

From the heat-shaping machine 1 illustrated at the top of FIG. 1 in the elongate transverse rectangle a row of packs 2 arrives on a supporting grid 3 after being turned over into the horizontal position, on which supporting grid a row of six pairs of packs 2 can be seen fixed horizontally adjacent to each other, opening against opening. It is possible to imagine a row of packs of twice the length, as shown in the bottom devices, namely a row of twelve packs 2 arranged behind one another. The first separation device 4 separates the pairs of rows in such a way that after passing through the separation device 4 each row of packs 2 is placed individually next to the other, as illustrated in the conveyer- and processing device which is denoted generally by the reference numeral 5.

In FIGS. 2 to 4 it is also possible to see the supporting grid 3 viewed from the front, looking from the bottom to the top in FIG. 1. The supporting grids 3 are pivotable about the axis 6' through 90° into the vertical position (not shown). From this position, the respective row of packs can be introduced in the direction of the arrow Y in FIG. 1 into the processing- and conveyer device 5, where the respective row of packs 2 is deposited onto the support rods and mounting strips in the direction of the arrow Z (FIG. 2), as described hereinafter.

FIG. 1 takes a view in the Z-extent, and it is supposed that the rows of packs 2 which are arranged furthest to the right in the conveyer- and processing device 5 are already disposed under the supporting grid 3. These then pivot back through 90° up into the position shown in FIGS. 2 to 4, so that the next rows of packs can be taken from the heat-shaping machine 1.

The rows of packs 2 are moved amongst others in the conveyer- and processing device 5, the centre and main axis of which are shown in FIGS. 2 to 5, by the horizontal displacement device 6 (FIGS. 8 to 10) in the direction of the arrow X. When they have reached the position shown furthest to the left in X direction of conveyance in FIG. 1 of the horizontal displacement device 6, they are pushed in the Y-extent into the top screw on device 7 (FIG. 11) into the position shown furthest to the left in FIG. 1, whereupon they are brought horizontally counter to the direction of the arrow X (after the interposition of vertical movements in the Z-extent) into a position for final removal.

In FIG. 1 it is clear to see that the rows of packs 2 are manufactured in the heat-shaping machine 1, are sent in the Y-direction to the conveyer- and processing device 5, are filled there and closed, and are then moved back in the Y-direction into the top screw on device 7 and are thence conveyed away after being provided with the top.

Whilst FIGS. 2 to 4 are better suited to describing the actual paths of movement of the rows of packs 2 and the course of operation, the conveyer- and processing device 5 shall first of all be shown in FIGS. 5 to 10 and described there.

The rows of packs 2 are supplied in the Y- and Z-extents, wherein FIG. 5 shows a pair of rows of packs 2 in the Z-extent on the way from the supporting grid 3 to the horizontal displacement device 6.

To simplify the drawing, and for the sake of clarity, the horizontal displacement device 6 is shown in FIG. 5 as if the two guide rods 8, to be described in greater detail hereinafter, are disposed in the Z-extent at one and the same height, but the more accurate drawings in FIGS. 7 to 9 show that for design-related reasons and for manufacture-related reasons the guide rods 8 are actually arranged in displaced relationship to one another in the Z-extent at the level of their own radial extents. However, the principle remains the same and can therefore also be described with the aid of FIG. 5In FIG. 5, both the horizontal displacement device 6 and the vertical conveyer device 9 are disposed in one and the same bottom conveyance position, namely in the Z-extent. Both devices 6 and 9 are one-step devices, i.e. they always make oscillating movements through one step, wherein the oscillation amplitude corresponds to the length of the step.

The series of processing stations which will be described more specifically hereinafter and which are arranged behind one another, as shown in the drawings, are disposed at a spacing a, shown in FIG. 5, above the common bottom conveyance position of the two main conveyer devices 6 and 9. The processing stations are thus disposed vertically in the Z-extent above the main conveyer devices 6 and 9, since this means that conveyance and processing can be separated locally from each other.

Vertical Conveyer Device 9

To facilitate an understanding of FIG. 5, it is expedient to first of all explain the vertical conveyer device 9 with the aid of FIGS. 6 and 7. In the overall direction of conveyance X of the horizontal displacement device 6 it has three sections behind one another, which are each able to be driven and controlled in various ways. Each section has a geared motor 10 with a cam drive 11, so that a synchronous shaft is able to provide vertical movement up and down in the Z-extent for the lifting mechanisms 13. The lifting mechanisms 13 which are fixed to the synchronous shaft 12 have a horizontal bridge 14 at the top which is consequently movable vertically. Each bridge 14 has at least two support rods 15 which likewise extend horizontally and which are arranged in mutually parallel relationship and perpendicularly to the direction in which the bridge extends. The support rod 15 which is arranged furthest to the right in FIG. 6 is in the form of an elongate corner of L-shaped cross-section for operation-related reasons and for space-related reasons, whilst the left-hand support rod 15, like all the other support rods 15, on the same right-hand, shortest bridge 14 is designed in the form of a rod. The number of these support rods 15 can be seen in FIG. 5. FIG. 6 shows that eleven rows of packs in the section which is frontmost in the X-extent, that three rows of packs in the central section, and that two rows of packs in the rear section, can be lowered in the Z-direction or can be lifted up in the direction counter to the arrow Z, each section separately. With respect to the plane of the rows of packs 2 it should be noted that it is perpendicular to the paper plane in FIG. 6 and extends in the X-extent, wherein the bridges 14 extend in the X-extent and lie in that plane like the support rods 15 which extend in the Y-extent. This Y-extent is shown in FIG. 7.

Horizontal Displacement Device 6

A good description of the horizontal displacement device 6 can be given with the aid of FIGS. 8 to 10. This has two mutually parallel guide rods 8 which are arranged at a spacing B apart and which are merely connected to a drive bar 16 which is shown to the right in FIGS. 8 and 10. A cam drive 17 is responsible for providing oscillating movement of the two guide rods 8 axially, i.e. in the X-extent. To prevent any dirtying from oil the sliding location 19 of the horizontal guide rods 8 is covered by a shell 20. A ball box guide 21 is responsible on either side for mounting the guide rod 8. The cam drive 17 and harmonic motion produce the oscillating movement of the guide rods 8.

Disposed on the guide rod 8 is a plurality of shims 22, on which mounting strips 24 which project towards one another are arranged horizontally in the space between the two guide rods 8, these mounting strips carrying guides 23. FIG. 10 is the plan view of the supporting surface, looking in the Z-extent, and it is possible to see the way in which the mounting strips 24 span a rake-like grid. All the mounting strips 24 are arranged in parallel relationship at a spacing from the respectively adjacent mounting strip. In the direction of the axis of the guide rods 8 it is possible to see, in FIG. 10, the axial spacing c between two mounting strips 24 of the upper group, for example. The bridge 14 can be moved up and down vertically in the Z-extent through the central slot 25 which extends in the X-extent and which is disposed in the plane of the mounting strips 24. The transverse slots 26 extend transversely to the central slot 25, and of these slots in FIG. 10 the two pairs of transverse slots 26 are somewhat wider than the others arranged further to the left. The support rods 15 which extend transversely to the bridges 14 can move up and down vertically through the transverse slots 26, likewise in the Z-extent, clearly together with the bridges 14 to which they are fixed. In other words, the horizontal spacing b between the two guide rods 8 is greater than half the length of a mounting strip 24, whereby the central slot 25 is formed.

Closure Device

If a view is taken in FIG. 1, in the Y-extent, onto the processing- and conveyer device 5, then this is the view in FIG. 5. The device for closing the packs 2 is fixed at its right-hand end. It has a supply roll 29, or a number of these supply rolls 29 on the same axis for the row of a plurality of packs arranged behind one another. One web of a sealable, thin plastics film 30 can be dawn off from this supply roll 29 in the direction of the arrow 31. Therein, the web of film 30 is drawn off by way of draw-off rollers 32 and by way of the tightener pulley 35 which is hinged to the rocking lever 33 to pivot in the direction of the two-directional arrow 34. After leaving the last direction-changing roller 36, the web of film 30 of an advancing device 37 is supplied with suction plates 38 from below and with a plate 39 from the top (FIG. 5) and is held there. The advancing device 37 moves the web of film 30 by one section of film, the width of which is approximately equal to the filling opening of the pack in the X-extent, is advanced and is separated at the location of the arrow 40 in FIG. 2, after this section of film has been brought under the heated vacuum stamp 41. The vacuum stamp itself is not oscillating, but is almost stationary in one place, i.e. is mounted so that it is elastically movable. This is obtained by springing by way of the heated vacuum stamp, and the purpose of it is that the pack which is guided up vertically in the opposite direction to the arrow Z is pressed with its opening in the top against the hot vacuum stamp from which the section of film is hanging down, so that in this way the section of film is sealed down onto the smoothed ready edge. The pack is thereby closed.

The advancing device 37 which moves in the direction of the two-directional arrow 42 then moves back into its retracted position, and in so doing, by the reciprocal action of the vacuum devices between the bottom vacuum plate 38 and the top vacuum plate 39, the section of the web of film 30 which is first of all still cold is pushed under the vacuum plate 41, whereupon the same procedure is repeated. Thereby, the sections of film are conveyed intermittently to the heated vacuum stamp 41.

Top Screw On Device 7

If FIG. 1 is studied along the line XI—XI, then it is possible to see the top screw on device 7 which is shown in detail in FIG. 11. In a frame 27 this device 7 has a supply roll 28 for a web with screw tops 43 which are joined together by way of small bridges, not shown, which are about 10 mm in length in such a way that the U-shaped web of screw tops 23 shown in FIG. 11 results. In the direction of the curved arrow 44, this web of screw tops 43 is drawn off from the supply roll 28 which is arranged at the bottom right. If an entire row of packs 2 is to be fitted with tops, the arrangement according to FIG. 1 is used with the corresponding number, i.e. a plurality of supply rolls 28 is arranged on the same axis behind each other, in accordance with the number of packs 2. At the same time, these webs with screw tops 43 are advanced intermittently in the direction of the curved arrow 44 by the pull-off lever 45.

After separation by means of a cutting blade, only shown by the arrow 46, the individual screw tops 43 are separated, and then are placed from above in front of a receiving means 47 vertically in the Z-extent. The receiving means is a disc which is rotatable about an axis 48. The drive means for it is the geared motor 49. The geared motor 50 which is shown to the left of it is used for pivotal movement of the receiving means 47 through 90° in the direction of the arrow 51 about a further axis 52 which is disposed vertically on the first axis of rotation 48 horizontally and in the viewing direction of FIG. 11. The receiving means 47 pivots about this first horizontal axis 52, in the direction of the curved arrow 51, though 90°, anti-clockwise and down, so that when the receiving means 47 rotates, the screw top 43 is then screwed onto the pack (or row of packs) and the sealed plastics film largely covers it.

The row of packs 2 is lifted from the bottom support means 53, shown in FIG. 11, and is held stationarily at the top next to the sidepiece 54, whilst the screw top 43 is twisted on the outer thread of the pack. After, for example, ten screw tops have been screwed on, the closed row 2 is pushed in the direction of the arrow 55 to the left into a receiving device which is generally denoted by the reference numeral 56, in which device a stationary blade 57 and the blade 58 which rotates towards it are disposed. When the row of packs is conveyed down from the upper position shown in FIG. 11, next to the arrow 55, to the left in the Z-extent and down, i.e. during the downward movement between the blades 57 and 58, the individual packs 2 are mutually separated, and then are disposed at the bottom on the support means 59, which, in FIG. 1, corresponds to the series of circles shown at the bottom, furthest to the right. The thrust means 60 then brings the separated row of packs 2 from the left to the right, in FIG. 11, (from the right to the left in FIG. 1) onto a removal belt 61 which is only shown schematically in FIG. 1. In FIG. 1, it is possible to see the horizontal axis 62 of the conveyer under the conveyer belt 61, and a spacing to the right thereof is the horizontal axis 63 of the conveyer for supplying the row of packs from the conveyer- and processing device 5 in the Y-extent, as also shown in FIG. 7. The brake lever 64 for the supply roll 28 in FIG. 11 does not need to be described here in greater detail, for its alternative positions are shown by shading, and its braking function is known per se.

Aseptic Stage

If the conveyer- and processing device 5 is used in aseptic operation, an aseptic housing 65 is provided which has feed tubes and outlet tubes, not shown, for sterile gases. This design for the aseptic device—also called the aseptic stage because of the transportation stage—can best be described with the aid of FIGS. 2 to 4, wherein FIG. 3 will be used in particular. The horizontal displacement device 6 has been omitted to make the drawing simple and to make it clearer to understand. Instead, it is only possible to see the conveyed packs 2. Disposed over part of the total length of the horizontal conveyer belt in the X-extent is a housing with channelling units 66' to the left, 67, 67' in the centre of a dividing wall 68 and 69 to the right at the transition to an ante-chamber 70 for keeping the web of plastics film 30 sterile. Whereas the housing 65 with the ante-chamber 70 is stationary, the channelling units 66 to 69 can move backwards and forwards with oscillating motion through a stage in the X-extent.

The part of the housing 65, disposed to the left of the dividing wall 68, embraces five processing stations which are arranged behind one another in a row in the form of intensive chambers 71 to 75, whilst the right-hand part of the housing 65, in the direction of conveyance behind the dividing wall 68, embraces the two feed pipes 76 and 77. The housing 65 which acts as the last processing station also embraces the vacuum stamp 41, already described.

In addition, parts of the two main conveyer devices 6 and 9 are disposed inside the housing 65 which is filled with sterile gas.

The vertical conveyer device 9 lifts the rows of packs vertically in the Z-extent up over the height of the processing stations, wherein, in FIG. 3, the five rows of packs which are arranged in the left-hand part of the housing 65 arrive at the intensive chambers 71 to 75. After they have been fully introduced into these intensive chambers, these latter are closed by the movable covers 78.

Operation of the Device

The packs which are placed up high vertically and which are separated by the separation device 4 in the Z-extent are supplied in a way which has been described hereinabove. With every second stroke, a pair of horizontally disposed rows of packs arrives at the supporting grid 3. As a result, with every stroke, a row of packs 2 is moved vertically in the Z-extent down into the upper position shown in FIG. 2. All rows of packs which have been previously supplied are then likewise disposed in the upper conveyance position of the vertical conveyer device 9, as shown in FIG. 2.

With the next step, the row of packs moves into the bottom conveyance position which is shown in FIG. 3. Without moving and without disturbing the vertical conveyer device, the row of packs in question then moves with the aid of the horizontal displacement device 6 through a step to the right in such a way that the channelling units 66 and 66' move from the position shown in FIG. 3 into the position shown in FIG. 4. It can be seen that the right-hand channelling unit 66' is disposed inside the sterile housing 65, whilst the sealing is provided by the channelling unit 66 to the left.

The vertical conveyer device 9 lifts the series of rows of packs back up into the next conveyance position, so that the empty horizontal displacement device 6 can move through one step to the left, so that the channelling units 66, 66' are disposed back in the position shown in FIG. 2.

If FIG. 5 is studied in comparison to FIG. 4, then it is seen that in processing station I, on the row of packs in question, the corners which project from the overhanging central seam are cut off, and in position II the top edge of the collar at the pouring- or filling opening of the pack is heated up. In Position III, cold deformation takes place of the heated sealing edge to prepare and smooth same, in order to make it capable of adhering and sealable, and to later enable it to be joined to the plastics film.

After this processing operation in position III, the row of packs is lowered and it then has then reached the position which is shaded black in FIG. 3 or the position between the two channelling units 66 and 66'. Next, the horizontal displacement device 6 moves into the advanced position, so that the position shown in FIG. 4 is reached. The row of packs which is shaded black is then introduced into the upper position IV into the first intensive chamber 71, whereupon the covers 78 close. The row of packs is heated by hot air. Alternatively, the row of packs could also be heated by infra-red light.

In the housing 65, the part to the left of the dividing wall 68 is the sterilisation chamber, whilst to the right behind it the second part is the sterile chamber. In the sterilisation chamber there is an excess pressure of sterile gas, and the housing 65 is closed by the channelling unit 66.

A downward movement which continues to the right and then back up brings the row of packs into the second intensive chamber 72 and it is disposed in position V. Hydrogen peroxide gas is introduced through the pipe 79 into the second intensive chamber 72. $H_2O_2$ gas is sucked out of each intensive chamber 71 to 75 separately, for example as shown at 80 in FIG. 4 at the bottom, at the intensive chamber 72. A small amount of the air which is greatly charged with the $H_2O_2$ gas is firstly sucked into the sterilisation chamber and is then sucked out mainly at 80. The $H_2O_2$ has condensed on the outside and inside surfaces of the pack which is to be sterilised.

The pack which is still damp from the condensed $H_2O_2$ gas arrives at the next intensive chamber 73 after further stages, and it there reaches the position VI. This is the first drying chamber. The pack then arrives at the second drying chamber in position VII in a similar way, and it then arrives at the drying chamber arranged downstream thereof in position VIII. In this last drying chamber, the intensive chamber 75, the pack or row of packs is sterilised, dried and made warm and is deposited on the horizontal displacement device 6 down in the Z-extent, and is guided further to the right into the sterile chamber by the second channelling means with the channelling units 67 and 67". There, the row of packs is filled in the positions IX and X. In the sterile chamber, disposed to the right of the dividing wall 68, in the housing 65 the excess pressure of sterile gas is greater than in the sterilisation chamber arranged to the left of it.

The web 30 of plastics film arrives via the aseptic channelling means 81 and thence in the afore-described way into the sterile chamber 70 and under the heated vacuum stamp 41. The way in which the section of film is sealed by moving up the still unclosed row of packs towards the vacuum stamp 41 has already been described hereinabove. The contents are therefore filled into the pack 2 under aseptic conditions, and the pack is closed under aseptic conditions.

By creating the intensive chambers 71 to 75 which are closable by the covers 78, sterilisation with concentrated $H_2O_2$ gas flow can take place, wherein a considerable amount of gas is saved. This would not be possible without the intensive chambers in the housing 65 because often packs are moved in and out through the channelling means, so that a lot of the sterilising agents are lost. In addition, this would be emitted to the atmosphere or surroundings, which is considered as harmful. Highly intensive sterilisation gases are used because of the closable covers 78 in the intensive chambers 71 to 75, in order to lose as little sterilising agent as possible to the outside. Sterilising gas is then only allowed to flow if the intensive chambers 71 to 75 are closed. After the row of packs has left position XI, the row passes through a position of rest XI and is then closed in position XII with the aid of the heated vacuum stamp 41 in the afore-described way by the respective section of film. The row of packs is then lowered to the bottom level and is moved out of the housing 65 by the right-hand channelling means. In this position, the row of packs is lifted up into an empty position XIII by the elongate support rod 15 which is of L-shaped cross-section, and is then put back down. The horizontal displacement device 6 then moves the row to the right into the position XIV shown in FIG. 5, where other corners of the sealing seam are cut off.

Then, with the return stroke of the displacement device 6, i.e. when the two guide rods 8 move back in the direction opposite to the arrow X, the pack is placed onto the conveyer which is shown in FIG. 7, where it is conveyed away in the Y-direction.

The row of closed packs then enters the top screw on device 7, operation of which has been already described hereinabove in the description of the device.

We claim:

1. A device for conveying and processing packs for liquids, comprising:

a feed conveyer;

a plurality of processing stations, including processing stations for filling and closing of the packs, arranged sequentially, the feed conveyor being arranged for feeding packs to the processing stations;

a removal conveyer being arranged for removing processed packs from the device;

a first main conveyer device, the first main conveyer device being a one-step vertical conveyer device and having at least one vertically movable bridge with at least one horizontally arranged support rod for transporting a plurality of packs simultaneously; and a second main conveyer device, the second main conveyer device being a one-step horizontal displacement device, the first and the second main conveyer devices have a common conveyance position at a bottom one of two conveyance positions of the first main conveyer device, the processing stations for filling and closing of the packs are arranged vertically above the first and the second main conveyer devices (6, 9), and the support rod is of sufficient length to transport a plurality of packs arranged in a row relative to one another.

2. A device according to claim 1, wherein the first main conveyer device includes at least two separately driven sections, each section having a vertically movable bridge with at least one horizontally arranged support rod (15) for transporting a plurality of packs simultaneously.

3. A device according to claim 1, wherein the first-main conveyer device includes three sections, each section having three bridges of different length, a rear one of the bridges carrying, in a first direction of conveyance, two support rods, and a central one of the bridges having three support rods which are arranged relative to each other, in a parallel relationship, in a spaced apart manner.

4. A device according to claim 1, wherein the second main conveyer device has two axially movable guide rods, arranged relative to each other in a parallel relationship and in a spaced apart manner, the guide rods each having a plurality of transversely arranged mounting strips which extend one after another in a parallel relationship, axially spaced apart, and in pairs in a space between the guide rods, the plurality of mounting strips on the guide rods defining a central slot.

5. A device according to claim 5, wherein a plurality of transverse slots are defined by adjacent ones of the mounting strips, the transverse slots extending transversely to the central slot (25), and the two guide rods are connected by a drive bar which extends transversely between them.

6. A device according to claim 5, wherein the bridge of the first main conveyer device is movable vertically through the central slot and the support rods are movable vertically through the transverse slots.

7. A device according to claim 1, wherein a processing station for closing packs includes a heated, substantially stationary vacuum stamp and a vacuum operated advancing device is arranged next to the pack closing processing station for intermittently feeding sections of film drawn from a supply roll in the form of a film web.

8. A device according to claim 1, further comprising a top screw on device for screwing tops onto packs, the packs being conveyed to the top screw on device in rows of attached packs, the top screw on device including an integrated separating device for separating attached closed packs from one another, and a receiving means for receiving a supply of tops and screwing them onto packs.

9. A device according to claim 1, wherein at least some of the processing stations are disposed inside of a housing having supply lines and outlets for sterile gases, and the first and the second main conveyer devices are disposed inside of the housing.

10. A device according to claim 9, further comprising a series of intensive sterilization chambers, the chambers each being closable by a cover, the chambers being arranged sequentially inside the housing above the processing stations, the first and the second main conveyers conveying packs vertically and horizontally, respectively, such that the packs are fully received in and fully removed from each one of the chambers, successively.

11. A device according to claim 1, wherein the processing stations are arranged on two planes, a distance between an upper one of the planes and a lower one of the planes being greater than a height of a pack.

* * * * *